US006817805B2

(12) United States Patent
Mettler et al.

(10) Patent No.: US 6,817,805 B2
(45) Date of Patent: Nov. 16, 2004

(54) TRAFFIC CHANNELIZER DEVICES

(75) Inventors: Charles M. Mettler, Perry, OH (US); Gregory H. Brown, Stow, OH (US)

(73) Assignee: Plastic Safety Systems, Inc., Cleveland, OH (US)

( * ) Notice: Subject to any disclaimer, the term of this patent is extended or adjusted under 35 U.S.C. 154(b) by 0 days.

(21) Appl. No.: 10/357,902

(22) Filed: Feb. 4, 2003

(65) Prior Publication Data

US 2004/0151543 A1 Aug. 5, 2004

(51) Int. Cl.[7] ..... E01F 15/00
(52) U.S. Cl. ..... 404/6; 404/10
(58) Field of Search ..... 404/10, 6–9; 116/63 R, 116/63 P; D10/113

(56) References Cited

U.S. PATENT DOCUMENTS

| | | | | | |
|---|---|---|---|---|---|
| 3,952,690 | A | * | 4/1976 | Rizzo et al. | 116/63 P |
| 4,083,033 | A | | 4/1978 | Kulp et al. | |
| 4,312,600 | A | * | 1/1982 | Schaaf et al. | 404/6 |
| 4,511,281 | A | * | 4/1985 | Schmanski | 404/10 |
| 4,611,949 | A | * | 9/1986 | Schmanski | 404/9 |
| 4,674,431 | A | * | 6/1987 | Cory | 116/63 P |
| 4,710,053 | A | * | 12/1987 | Kulp et al. | 404/9 |
| 4,973,190 | A | * | 11/1990 | Erwin et al. | 404/10 |
| 5,026,204 | A | | 6/1991 | Kulp et al. | |
| 5,201,599 | A | * | 4/1993 | Kulp et al. | 404/6 |
| 5,234,280 | A | | 8/1993 | Cowan | |
| 5,451,118 | A | * | 9/1995 | Wilkins et al. | 404/6 |
| 5,560,732 | A | | 10/1996 | Kulp et al. | |
| 5,630,675 | A | | 5/1997 | Boeger | |
| 5,713,694 | A | | 2/1998 | Monda et al. | |
| 5,722,788 | A | | 3/1998 | Bent et al. | |
| 5,755,528 | A | * | 5/1998 | Kulp et al. | 404/6 |
| 5,868,520 | A | | 2/1999 | Kulp et al. | |
| 6,019,542 | A | * | 2/2000 | Bent et al. | 404/6 |
| 6,182,600 | B1 | | 2/2001 | Brown et al. | |
| 6,478,505 | B1 | | 11/2002 | Kulp et al. | |

* cited by examiner

*Primary Examiner*—Thomas B. Will
*Assistant Examiner*—Raymond W Addie
(74) *Attorney, Agent, or Firm*—Renner, Otto, Boisselle & Sklar, LLP

(57) ABSTRACT

A traffic channelizer device includes a deformable hollow plastic drum that may be ballasted by a drop over ballasting collar or by a base having an upper portion that may be releasably retained within the open bottom of the drum by a plurality of circumferentially spaced radially inwardly extending locking fingers adjacent the bottom edge of the drum that releasably engage a groove in the upper portion of the base. An intermittent stacking rim may be provided at the top of the drum to prevent overstacking of a plurality of such drums. Also the intermittent stacking rim may be used to prevent rotation of a portable sign assembly relative to the drum and keep the portable sign assembly from inadvertently sliding up off the drum top.

21 Claims, 7 Drawing Sheets

TRAFFIC CHANNELIZER DEVICES

FIELD OF THE INVENTION

This invention relates generally to traffic channelizer devices for use in guiding and directing vehicle traffic around road and highway construction sites and the like.

BACKGROUND OF THE INVENTION

There are many different types of traffic channelizer devices for directing and channeling traffic flows. One type that is widely used comprises a hollow drum made of a relatively lightweight plastic material that will cause little or no damage to a vehicle if the vehicle should accidentally strike the drum.

Because such hollow plastic drums are relatively light in weight, some type of ballast is needed to prevent the drums from being inadvertently blown over or moved about by the wind and/or air blasts produced by passing vehicles. One common form of ballast comprises one or more rubber-like collars that may be placed over the drums for exteriorly ballasting the drums. Such collars may be molded out of a suitable rubber-like material or comprise a relatively rigid bead portion and a relatively non-rigid integral side wall portion of a recycled tire such as a truck tire.

An example of one such drum and ballast system is disclosed in U.S. Pat. No. 5,234,280 assigned to the same assignee as the present application, the entire disclosure of which is incorporated herein by reference. The drum disclosed in this patent includes a radially outwardly and axially downwardly tapering skirt portion adjacent a bottom edge of the drum for resisting pull out of the drum from the ballasting collar so the drum cannot be blown or sucked out of the ballasting collar by the wind or passing vehicles. Also, the ballasting collar grips the road over a relatively large surface area to resisting tipping of the drum and eliminate "walking" of the drum on the ground which is common in plastic drums. However, the drum is deformable upon impact by a vehicle to cause the drum to collapse sufficiently to permit the skirt portion of the drum to pass through the ballasting collar to dislodge the drum from the collar leaving the collar behind.

There is a tendency for the drum to rotate relative to the ballasting collar especially when a warning light or other safety device is mounted off center on the top of the drum. This occurs from the wind and vacuum created by passing vehicles exerting a rotational force on the drum, and has the disadvantage that the drum may rotate such that only a portion of the warning light or other safety device is visible to oncoming traffic.

One known way of preventing drum rotation relative to the ballasting collar is to attach a friction pad to the lower outside surface of the drum for contact by the inner diameter of the collar when the collar is inserted over the drum. If the friction pads are cut from recycled tire tread pieces that vary too much in thickness or the ballasting collar is cut from recycled tires having inner diameters that vary slightly, the ballasting collar may either not adequately engage the friction pad to prevent relative rotation or the friction pad may interfere with the proper placement of the ballasting collar around the drum.

Another known way of preventing drum rotation relative to the ballasting collar is to attach two molded ribs to the bottom outside surface of the drum for contact with the inner diameter of the ballasting collar. A problem with using such molded ribs is that if the inner diameter of the ballasting collar is too great, the collar may not adequately contact the molded ribs to prevent rotation. Conversely, if the inner diameter of the ballasting collar is too small, the molded ribs may interfere with the proper placement of the ballasting collar over the drum. Moreover, the molded ribs add to the overall cost of the drums.

Another common form of ballast comprises a molded rubber base that is held in place inside the bottom of the drum by a continuous inturned lip on the bottom of the drum. One problem with this is that there is a tendency for the internal base to prematurely separate from the drum when the drum is tipped at an angle and dragged along the ground from one location to another. Also, repeated vehicle impacts and/or repeated dragging of the drum bottom along the ground may cause the inturned lip to become sufficiently distorted or worn that it is no longer effective in retaining the internal base inside the bottom of the drum.

The drums are typically stepped radially inwardly at discrete intervals along their length from the bottom toward the top to facilitate stacking of the drums during shipment and storage and to provide a plurality of axially spaced surfaces for applying one or more bands of reflective sheeting to the drums. However, care must be taken to prevent overstacking and lock up of the drums when stacked together. Otherwise it may be difficult to pull the stacked drums apart. Also it is desirable to protect the bands of reflective sheeting against damage during stacking.

It is also generally known to attach portable sign assemblies to traffic channelizer drums to provide a Type I or Type II directional barricade for redirecting traffic. Such portable sign assemblies should be easily attachable and removable from the drums to allow the portable sign assembles to be removed to permit stacking of the drums during transportation and storage.

One of the problems of making the portable sign assemblies easily removable from the drums is that the wind and vacuum created by passing vehicles may cause the portable sign assemblies to rotate relative to the drums such that only a portion of the portable sign assemblies may be visible to oncoming traffic. Also, the portable sign assemblies may slide up on the drums, causing the portable sign assemblies to prematurely become dislodged from the drums.

A need thus exists for improved traffic channelizer devices that eliminate one or more of the drawbacks of previous traffic channelizer devices outlined above.

SUMMARY OF THE INVENTION

The present invention relates to traffic channelizer devices including a drum that may be ballasted using different types of ballast.

In accordance with one aspect of the invention, the drum may have the ability to be ballasted either by a drop over ballasting collar or by a base that fits inside the bottom open end of the drum.

In accordance with another aspect of the invention, the internal base may be releasably held within the bottom open end of the drum by a plurality of circumferentially spaced radially inwardly extending locking fingers adjacent the bottom edge of the drum that snap into a radially outwardly facing channel or groove in an upper portion of the base.

In accordance with another aspect of the invention, the locking fingers may be generally triangular shaped and have a double wall for increased strength and rigidity to allow users to attach and remove an internal base from the drum with ease while preventing premature separation.

In accordance with another aspect of the invention, the drum may have a radially outwardly and axially downwardly tapering skirt portion adjacent the bottom edge of the drum for resisting pull out of the drum from one or more external ballasting collars placed over the drum.

In accordance with another aspect of the invention, the drum may have an arcuate or cylindrical shape over substantially the entire height of the drum including most of the circumference of the bottom edge of the drum. However, one side of the bottom edge of the drum may be substantially flat to serve as an anti-roll feature when the drum is tipped over on its side.

In accordance with another aspect of the invention, a plurality of circumferentially spaced axially downwardly and radially outwardly extending stiffening ribs or gussets may be integral with the periphery of the skirt portion of the drum. The stiffening ribs may progressively increase in size and extent of radial protrusion from the approximate midpoint of the arcuate portion of the bottom edge of the drum to where the stiffening ribs terminate adjacent opposite ends of the substantially flat side of the bottom edge to cause the ballasting collar to be slightly offset from the axial center of the drum in the direction of the flat side to ensure that substantially the entire weight of the ballasting collar rests on the ground.

In accordance with another aspect of the invention, an outwardly protruding mounting surface may be provided on the exterior of the drum adjacent the bottom edge of the drum for mounting of a friction pad on the mounting surface to prevent rotation of the drum relative to a ballasting collar placed over the drum in contact with the friction pad.

In accordance with another aspect of the invention, the friction pad may comprise a round section of a recycled tire tread.

In accordance with another aspect of the invention, the mounting surface for the friction pad may be resiliently deformable to accommodate different friction pad thicknesses and/or different inner diameter ballasting collars and still maintain sufficient contact between the inner diameter of the ballasting collar and the friction pad to prevent relative rotation between the drum and ballasting collar.

In accordance with another aspect of the invention, a single friction pad may be sized and shaped to cause the inner diameter of the ballasting collar to engage the friction pad at two circumferentially spaced places on opposite sides of the friction pad.

In accordance with another aspect of the invention, an intermittent stacking rim may be provided at the top of the drum to prevent overstacking and lock-up of a plurality of the drums stacked one on top of another.

In accordance with another aspect of the invention, the intermittent stacking rim may help protect reflective sheeting bands on the exterior of the drum against damage during stacking while increasing drum durability.

In accordance with another aspect of the invention, the intermittent stacking rim may be used to prevent rotation of a portable sign assembly relative to the drum when mounted on the top tier of the drum and keep the portable sign assembly from inadvertently sliding up off the top of the drum.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE INVENTION

Figure 1:
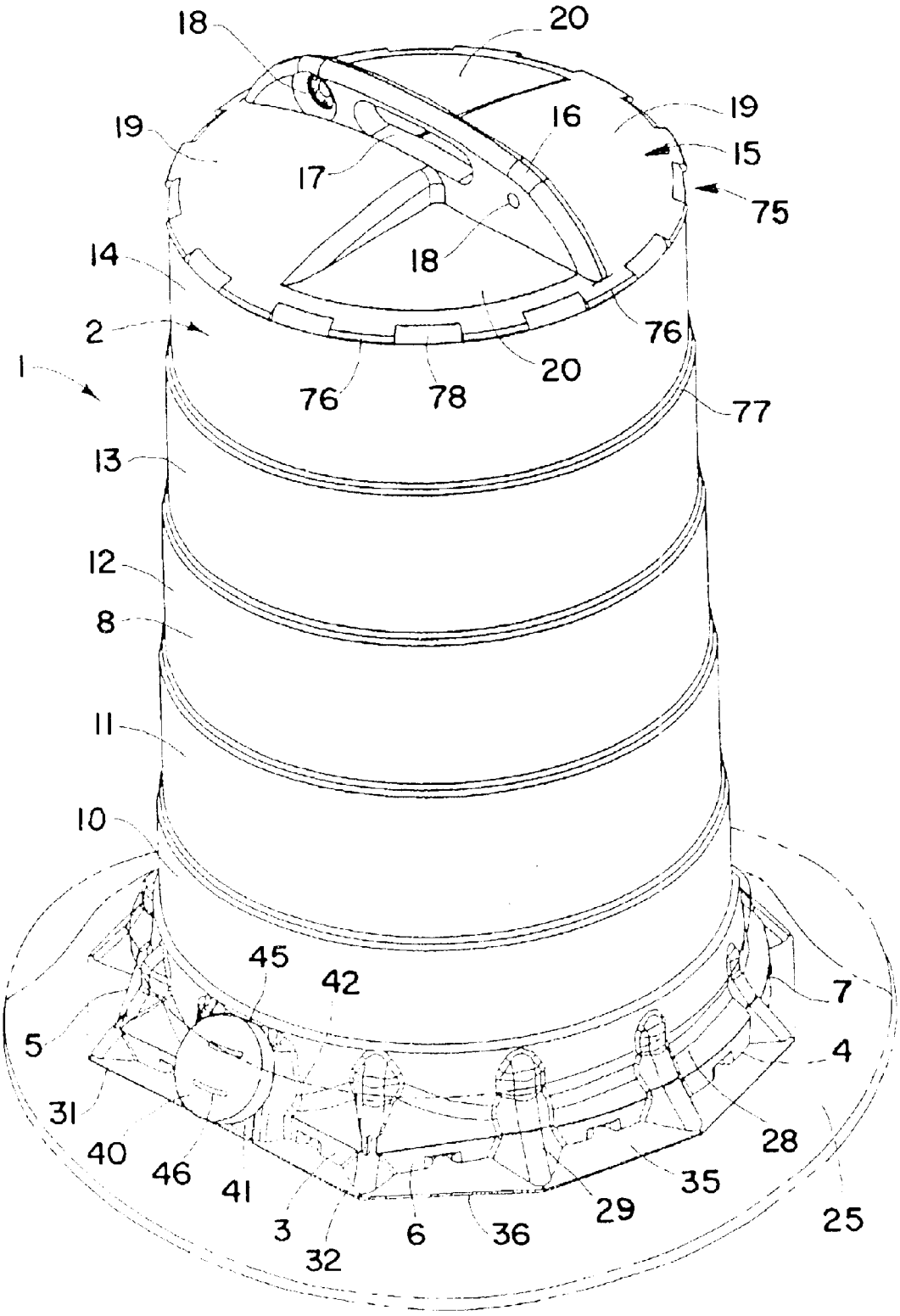
FIG. 1 is a perspective view of one form of traffic channelizer device in accordance with the present invention.
Figure 2:
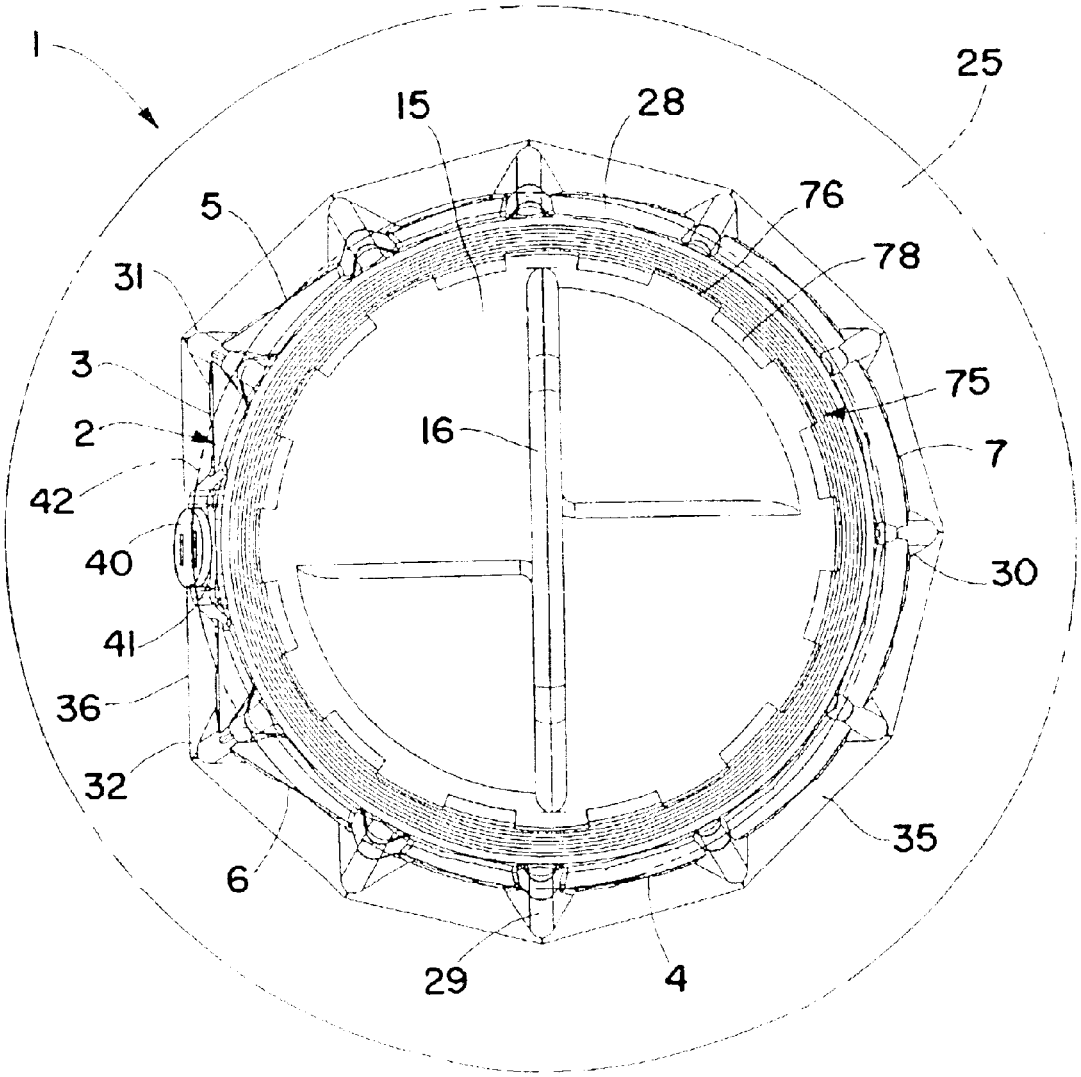
FIG. 2 is a top plan view of the traffic channelizer device of FIG. 1.

Referring now in detail to the drawings and initially to FIGS. 1 and 2, there is shown one form of traffic channelizer device 1 in accordance with this invention which includes a relatively thin walled, hollow plastic drum 2 that may be blow molded out of a relatively lightweight deformable plastic material such as a flexible low density or impact resistant high density polyethylene. The drum 2 may be generally cylindrical or arcuate in shape. Alternatively, the drum may have a cross-sectional "D" shape which is arcuate or semi-circular throughout most of its circumference but has one portion that is relatively flat, making the drum less prone to rolling when tipped over on its side.

The particular drum 2 shown in FIG. 1 has a generally arcuate or cylindrical shape over substantially its entire height. However, a relatively wide side 3 of the bottom edge 4 of the drum may be substantially flat to make the drum less prone to rolling when tipped over on its side. Also, portions 5, 6 of the bottom edge 4 adjacent opposite ends of the flat side 3 may extend at an angle relative to the flat side to blend with the remaining arcuate portion 7 of the bottom edge as best seen in FIG. 2.

In either case, the drum side wall 8 may be stepped radially inwardly at discrete intervals along the axial length of the drum from the bottom toward the top to facilitate stacking of a plurality of the drums for ease of handling and storage and to provide a plurality of axially spaced stepped surfaces to which one or more bands of reflective sheeting may be applied. In the embodiment shown in FIGS. 1 and 2, the drum has five such stepped surfaces 10–14 each having a height for example of approximately 6¼ inches, to any one or more of which bands of reflective sheeting may be applied.

Extending axially outwardly from the closed top 15 of the drum is an integrally molded handle 16 having a hand grip 17 to facilitate carrying of the drum from one location to another. Suitable mounting holes 18 may be provided in the handle for attachment of a warning light or other suitable warning devices thereto. Portions 19 of the drum top 15 may be dome shaped for increased strength. Also, one or more portions 20 of the drum top may be substantially flat to facilitate mounting of a light, sign or other traffic warning device on the drum top.

The drum itself is relatively light in weight, weighing for example approximately 7½ to 9 pounds. To prevent the drum from being blown over or inadvertently moved about by the wind and/or air currents produced by passing vehicles, the drum may be ballasted using one or more types of ballast as described hereafter.

Figure 3:
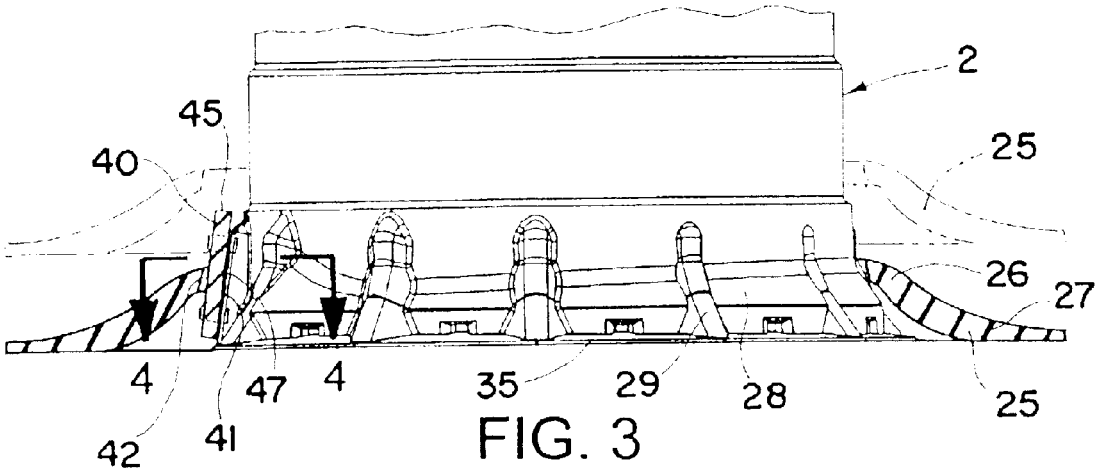
FIG. 3 is a side elevation view of the bottom portion of the drum of FIGS. 1 and 2 and transverse section through one form of ballasting collar placed over the drum.

FIGS. 1-4 show the drum being externally ballasted by one or more rubber-like collars 25 placed over the drum. The ballasting collars 25 may be molded for example out of recycled rubber. Alternatively, the ballasting collars may comprise the relatively rigid bead portion 26 and relatively non-rigid integral side wall portion 27 of a recycled tire such as a truck tire as shown in FIG. 3. Such a ballasting collar is shown and described in greater detail in U.S. Pat. No. 5,234,280, the entire disclosure of which is incorporated herein by reference. The tire bead 26, which constitutes the inner periphery of a recycled tire collar, is typically reinforced by steel wires, making it much more rigid and heavier than the tire side wall portion 27 which is made of a relatively soft, non-rigid rubber. When a tire collar 25 is placed over the drum with the inner surfaces of the tire bead 26 and tire side wall portion 27 facing upwardly, the tire side wall portion will make substantial flat contact with the ground around the entire periphery of the drum as schematically shown in FIG. 3.

To resist pull out of the drum 2 from an external ballasting collar 25, a radially outwardly and axially downwardly tapering skirt portion 28 may be provided adjacent the drum bottom. Also, a plurality of circumferentially spaced radially outwardly and axially downwardly tapering stiffening ribs or gussets 29 may be integrally formed with the skirt portion 28 to increase the stiffness of the skirt portion so the drum cannot be inadvertently blown or suctioned out from the ballasting collar by the wind or the vacuum produced by passing vehicles while still allowing the drum to collapse sufficiently to break away from the ballasting collar upon impact by a vehicle.

Where the drum includes a relatively wide flat side 3 adjacent the bottom edge 4 of the drum as previously described, the stiffening ribs 29 may progressively increase in size and radial extent of protrusion from the approximate midpoint 30 of the curved portion 7 of the bottom edge opposite the relatively wide flat side to the outwardmost protruding corners 31, 32 of the bottom edge adjacent the ends of the relatively wide flat side. This creates a substantially uniform diameter offset around the drum toward the relatively wide flat side, whereby when one or more ballasting collars 25 are placed over the drum, the stiffening ribs 29 will cause the collars to be slightly offset from the axial center of the drum in the direction of the relatively wide flat side 3 to ensure that the lowermost collar clears the outwardmost protruding corners 31, 32 so that substantially the entire weight of the lowermost collar rests on the ground rather than on the drum to establish substantial surface contact between the bottom collar and ground around the entire periphery of the drum as schematically shown in FIGS. 2 and 3. The stiffening ribs 29 may be rounded to provide increased flexibility and to eliminate any sharp edges for increased life of the drum when impacted by a vehicle during use. Also a multi-faceted flange 35 having flat outer edges 36 substantially corresponding in length to the spacing between the stiffening ribs 29 may extend outwardly from the bottom edge of the drum between the stiffening ribs 29 around the entire periphery of the drum.

In the embodiment disclosed herein, eleven such stiffening ribs 29 are shown, two adjacent opposite ends of the relatively wide flat side 3, and the other nine substantially uniformly spaced around the remaining periphery of the drum.

Providing such a ribbed skirt portion 28 and flange 35 adjacent the bottom of the drum still allows the drum to collapse sufficiently to break away from one or more ballasting collars 25 when the drum is impacted by a vehicle, leaving the ballasting collars, which constitute most of the weight of the traffic channelizer device, behind. A drum made in accordance with the present invention may weigh for example approximately 7½ to 9 pounds as aforesaid, whereas a single ballasting collar may weigh for example approximately 25 pounds.

Moreover, because of the modular nature of the ballasting collars 25, two or more such ballasting collars may be placed over a single drum, one on top of the other, to add additional ballast as needed in high-speed areas to stabilize the drum. One ballasting collar may have a height for example of approximately 3 inches. However, because the ballasting collars nest together when placed one on top of another, two such collars may have a combined height for example of approximately 4 inches.

Ballasting the drum with one or more ballasting collars 25 also has the advantage that the outer periphery of the lowermost ballasting collar will grip the roadway and eliminate any "walking" of the drum on the ground, which is a condition common to plastic drums. The wider the collar, the greater the surface contact between the collar and roadway to eliminate walking. Also a wider collar gives a lower center of gravity to the drum, whereby if the drum is tipped up, the drum will revert to vertical over a much wider angle of inclination.

To set up the drum with one or more ballasting collars, the ballasting collars may either be picked up and dropped over the top of the drum or the collars may be stood on their edge and the drum pulled through the collars to eliminate heavy lifting. For take down, the process may be reversed.

There is a tendency for the drum 2 to rotate relative to the ballasting collar 25 due to wind and vacuum created by passing vehicles exerting a rotational force on the drum especially when a warning light or other safety device is mounted on the top of the drum. This may disadvantageously cause the drum to rotate such that only a portion of the warning light or other safety device may be visible to oncoming traffic.

Figure 4:
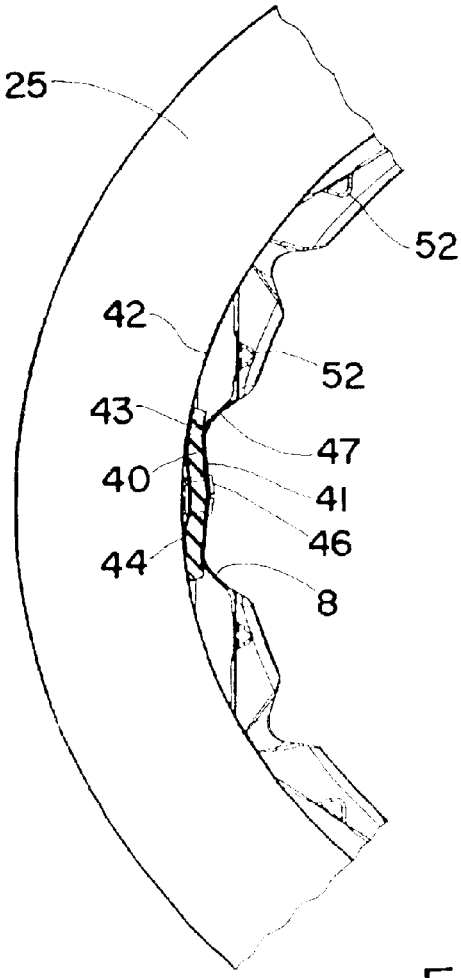
FIG. 4 is an enlarged fragmentary transverse section through a friction pad mounted on the drum, taken along the plane of the line 4—4 of FIG. 3.

To prevent inadvertent rotation of the drum relative to the ballasting collar, a friction pad 40 may be mounted on an outwardly protruding mounting surface 41 on the exterior of the drum adjacent the bottom edge thereof for frictional contact by the inner diameter of the ballasting collar. Mounting surface 41 may be located on the side of the drum adjacent the approximate center of the longer flat side 3 of the bottom edge 4 of the drum so the mounting surface and associated friction pad may be made large enough such that the inner diameter 42 of the ballasting collar 25 will engage the friction pad 40 at two spaced apart locations adjacent opposite sides 43, 44 of the pad as seen in FIG. 4. Also making the mounting surface 41 relatively large gives it greater flexibility such that friction pads 40 having slightly different thicknesses and/or ballasting collars 25 having slightly different inner diameters may be used with the drum and still provide the necessary contact between the inner diameter of the collar and friction pad to prevent relative rotation. For example, mounting surface 41 may have a width and height of approximately 4 to 4½ inches for supporting a friction pad 40 having a diameter of approximately 4½ inches which may be cut out of recycled tire treads having slightly different thicknesses. Also the ballasting collars 25 may be made out of the bead 26 and integral side wall portion 27 of recycled tires having slightly varying inner diameters. If the friction pad is somewhat thicker or the inner diameter of the ballasting collars is somewhat smaller, the mounting surface 41 will flex inward as needed to accommodate the different thickness pad and/or different inner diameter collars and still maintain the desired two point frictional contact between opposite edges of the friction pad and the inner diameter of the ballasting collar to prevent rotation of the drum relative to the collars.

Mounting surface 41 may be slightly tapered radially outwardly from top to bottom so the inner diameter of the ballasting collars 25 will easily clear the top edge 45 of the friction pad 40 when the ballasting collars are placed over the drum as schematically shown in FIG. 3. Also, mounting surface 41 may be somewhat concave across its width to cause the spin pad 40 to dish out when attached to the mounting surface to insure positive contact of the inner diameter of the ballasting collar with opposite edges of the friction pad as schematically shown in FIG. 4. Any suitable type fasteners 46 such as staples may be used to attach friction pad 40 to mounting surface 41. A recessed area 47 (see FIGS. 3 and 4) may be provided in the side wall 8 of the drum behind the mounting surface 41 that is large enough to accommodate the portion of the fastener 46 extending through the back side of the mounting surface so the fastener won't stick out and scratch the reflective sheeting of another drum when two or more drums are stacked one on top of another.

Figure 6:
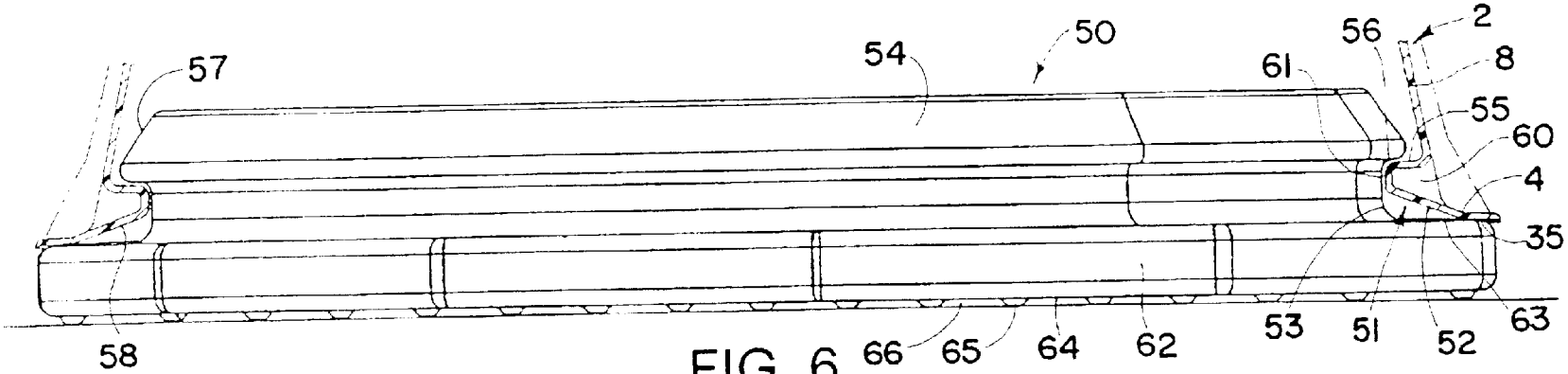
FIG. 6 is an enlarged fragmentary longitudinal section through the bottom edge of the drum of FIG. 1 showing an internal base mounted inside the bottom open end.

If desired, an internal base may also be used to ballast drum 2. FIG. 6 shows drum 2 ballasted by a base 50 that may be molded for example out of recycled rubber. Base 2 may be releasably held within the bottom open end 51 of the drum by a plurality of circumferentially spaced radially inwardly extending locking fingers 52 adjacent the bottom edge 4 of the drum that snap into a radially outwardly facing annular channel or groove 53 in an upper portion 54 of the base. Locking fingers 52 may be integrally molded into the drum side wall 8, and have a substantially flat radial top surface 55 for positive engagement with a substantially flat radial upper surface 56 of base groove 53 for retaining the upper portion 54 of base 50 within the open bottom of the drum. Both the uppermost outer edge 57 of the base and bottom side wall 58 of locking fingers 52 may have flat downwardly and outwardly tapered surfaces as shown in FIG. 6 for ease of insertion of the upper portion of the base past the locking fingers 52 during set up.

Figure 5:
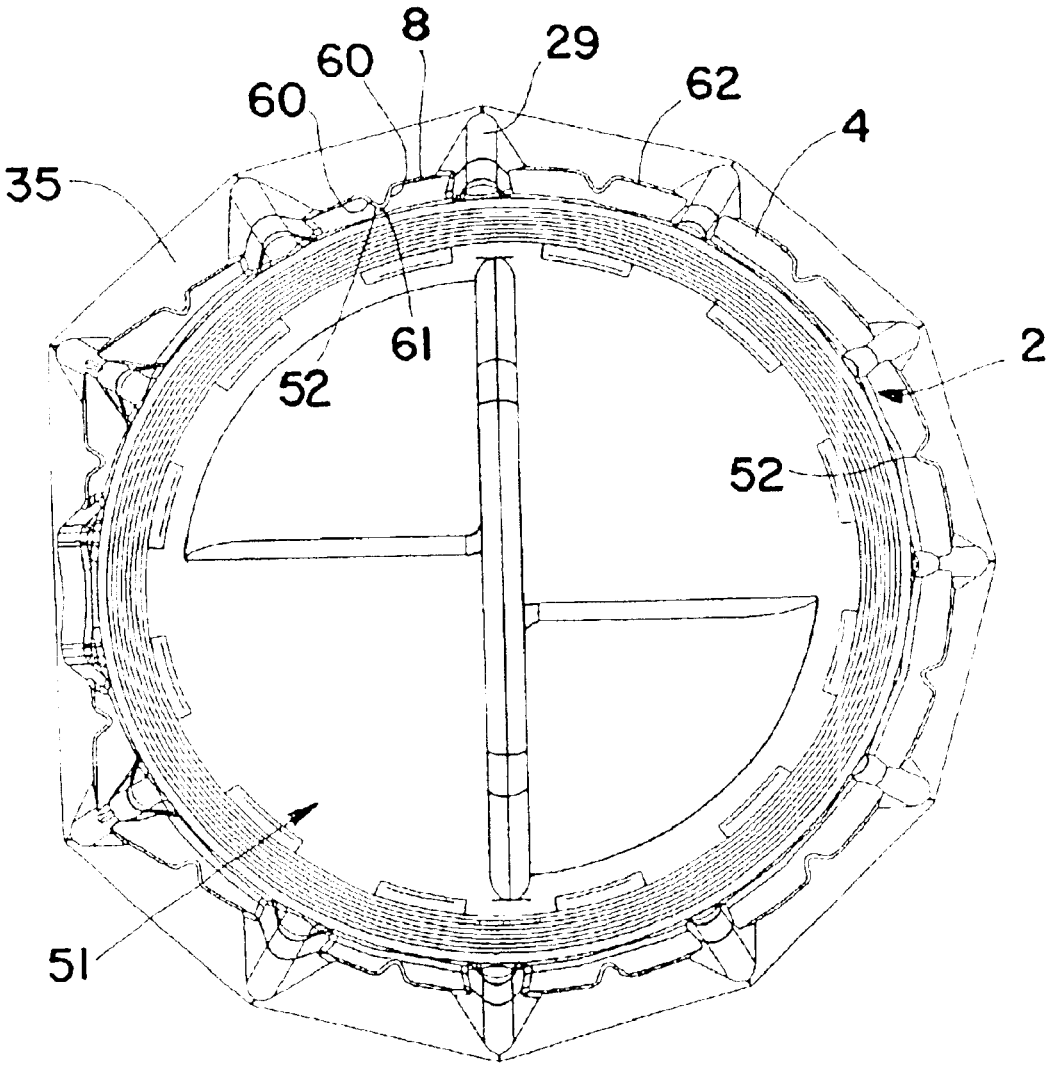
FIG. 5 is a bottom plan view of the drum of FIG. 1.

Such locking fingers 52 may be relatively small in width and depth and spaced relatively far apart around the inner periphery of the drum. Also such locking fingers may be generally triangular shaped and have a double wall for increased strength and rigidity so the locking fingers won't easily crush when the drum is impacted by a vehicle. There may for example be twelve such locking fingers around the inner periphery of the drum adjacent the bottom edge 4 as shown in FIG. 5. Each locking finger 52 may for example extend radially inwardly approximately ½ inch from the inner surface of the drum side wall 8 and may have a maximum width at the drum side wall of approximately 1 inch with opposite sides 60 that slope inwardly toward each other and a rounded inner tip 61. Also, the locking fingers 52 may be located on the sections 62 of the drum intermediate the stiffening ribs 29, whereby when the internal base 50 is inserted and removed from the drum (or the drum is impacted by a vehicle), the intermediate sections of the drum do most of the flexing, not the locking fingers themselves, making it relatively easy to insert and remove the internal base from the drum. Yet during normal use, the relatively tight fit of the locking fingers 52 within the base groove 53 will securely hold the upper portion 54 of the base in place inside the bottom of the drum and keep the drum upright due to the weight of the base, which may for example weigh anywhere between approximately 25 and 50 pounds depending on the amount of weight needed to keep the drum upright for a particular application. Also the locking fingers will keep the internal base from falling out of the bottom of the drum when the drum is dragged around with the base in place. Further, the locking fingers 52 may press against opposite sides of the base groove 53 as schematically shown in FIG. 6 to eliminate chatter between the drum and base. However, when the drum is impacted by a vehicle, the drum will flex or deform sufficiently to cause the drum to become dislodged from the base leaving the base behind, thereby reducing the risk of damage or injury.

Figure 8:
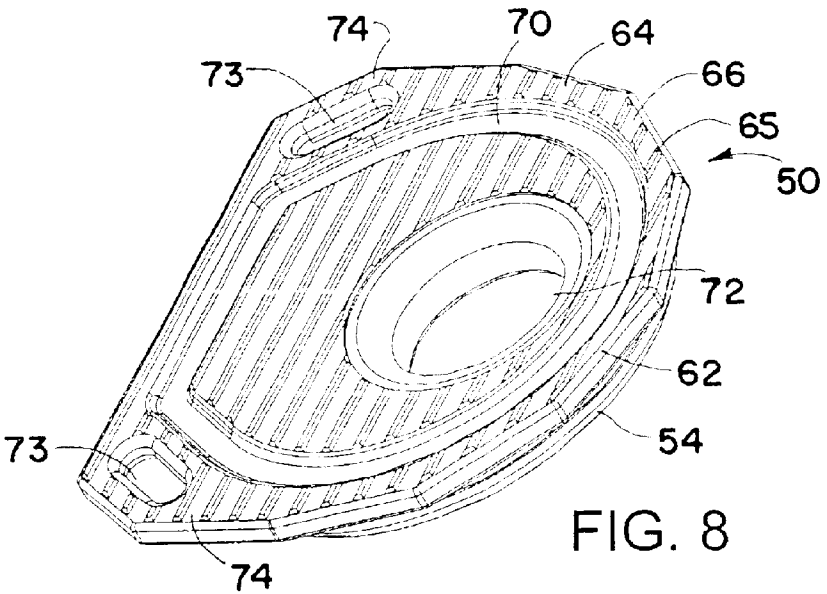
FIG. 8 is a perspective view of the internal base of FIG. 6 as seen from the bottom.
Figure 7:
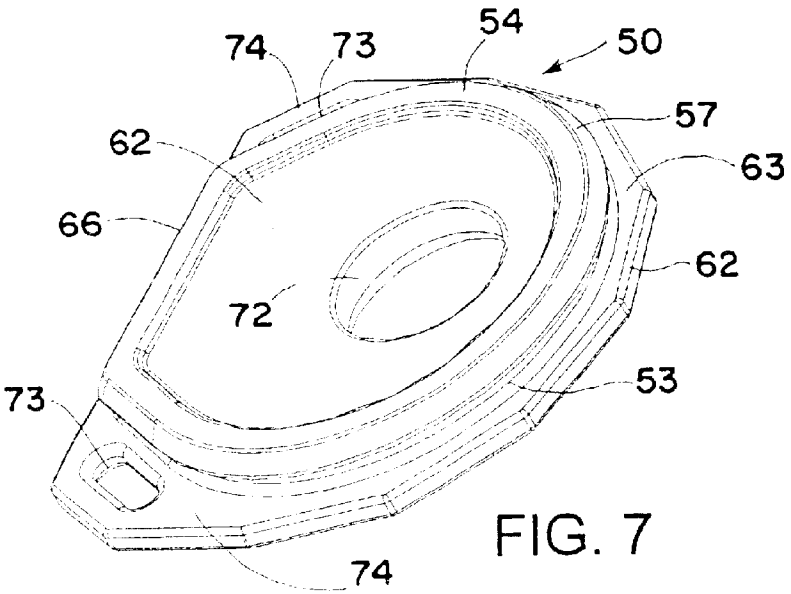
FIG. 7 is a perspective view of the internal base of FIG. 6 as seen from the top.

The upper portion 54 of the base 50 may be sized and shaped to generally correspond to the bottom open end of the drum which in the embodiment disclosed herein by way of example is generally "D" shaped. The lower portion 62 of the base 50 may be similarly shaped but extends radially outwardly beyond the upper portion 54 to provide a flat surface 63 (see FIGS. 6 and 7) that is engaged by the bottom edge 4 of the drum when the upper portion of the base is inserted into the bottom open end for supporting the drum a slight distance off of the ground as shown in FIG. 6. Base 50 may have a ribbed bottom 64 (see FIGS. 6 and 8 ) for improved stability. Also, the bottom ribs 65 are elongated and may all extend in the same direction substantially parallel to the straight side 66 of the upper portion 54 of the base that matches up with the flat side 3 of the drum bottom so that when the base and drum that comprise the traffic channelizer device 1 of the present invention are placed on the ground with the flat side of the drum extending generally perpendicular to the crown of a roadway, the ribs will from channels 66 between the ribs beneath the base allowing water to flow of the roadway.

An annular groove 70 (see FIG. 8) may be provided in the ribbed bottom 64 having a shape corresponding to but slightly wider than the upper portion 54 of the base for receipt of the upper portion of another base for stacking of two or more bases one on top of another. When stacked together, all of the bases will be in the same orientation because of the non-circular shape of the upper portion and correspondingly shaped bottom nesting groove 70 of the bases.

An axial hole 72 (see FIGS. 7 and 8) may extend through the base to allow the base to be used as an external ballast for other types of traffic channelizers such as 42 inch traffic cones and the like. Hole 72 may be offset to one side of the base to make that side as narrow as possible relative to the hole to minimize how far the base protrudes out on that side when placed over other types of traffic delineators for use in relatively tight work areas on that side. One or more hand grip slots 73 may also be provided in the corners 74 of the lower portion 62 of the base that extend outwardly beyond the straight side 66 of the upper portion 54 for use as carrying handles to facilitate picking up of the base for transport from one place to another.

To set up the drum 2 with the internal base 50, the drum open bottom 51 may be aligned over the upper portion of the base and pressed down firmly, causing the sides of the drum to elastically deform and allow the locking fingers 52 to snap into the groove 53 in the upper portion of the base. For take down, the drum may be placed on its side to allow the internal base to be pulled out of the drum bottom.

Figure 9:
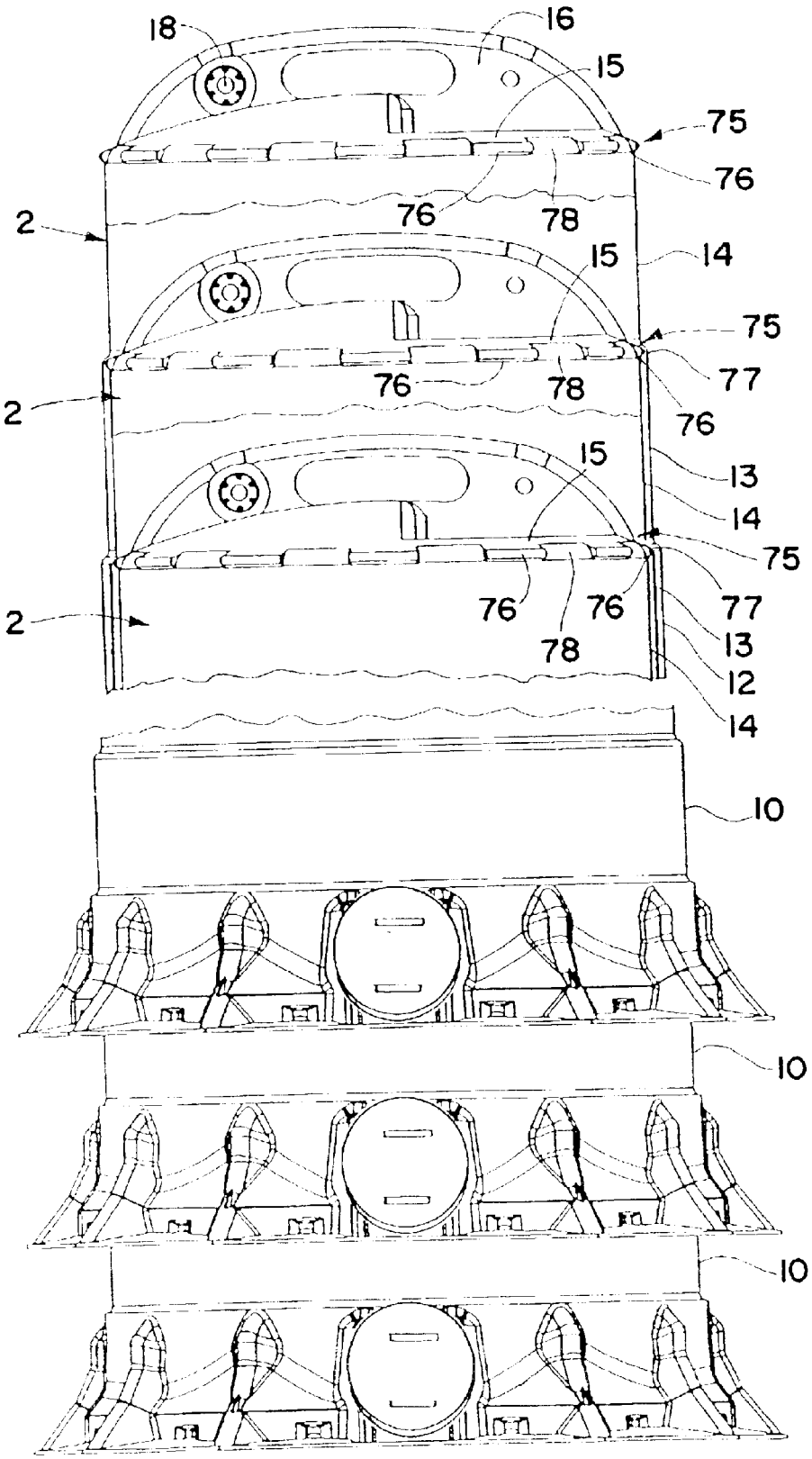
FIG. 9 is a schematic side elevation view, partly in section, showing three traffic channelizer drums of the present invention stacked one on top of another.

An intermittent stacking rim 75 may be provided on the drum top 15 to prevent overstacking and lock up of a plurality of stepped drums when stacked one on top of another. Such intermittent stacking rim 75 may comprise a plurality of circumferentially spaced, radially outwardly extending tabs 76 around the outer periphery of the drum top that protrude radially outwardly just enough to engage the transition shoulder 77 between the uppermost two stepped surfaces 13 and 14 of another drum over which the drum is placed to provide a clearance space between the stepped surfaces 10–14 of such stacked drums as schematically shown in FIG. 9. This reduces the friction between the stacked drums thus preventing them from sticking together for ease of unstacking. The tabs 76 of the intermittent stacking rim 75 cannot protrude beyond the inner diameter of the second uppermost stepped drum surface 13 or the tabs will interfere with stacking of the drums beyond the third uppermost stepped drum surface 12, which wouldn't allow for very much stacking. Between the stacking rim tabs 75 are air gaps 78 that allow for the free flow of air into and out of the drums during stacking and unstacking to prevent any build up of air pressure or vacuum between the drums. The outwardly protruding tabs 76 of the intermittent stacking rim 75 also help protect the bands of reflective sheeting on the stepped drum surfaces 10–14 while increasing drum durability.

Figure 10:
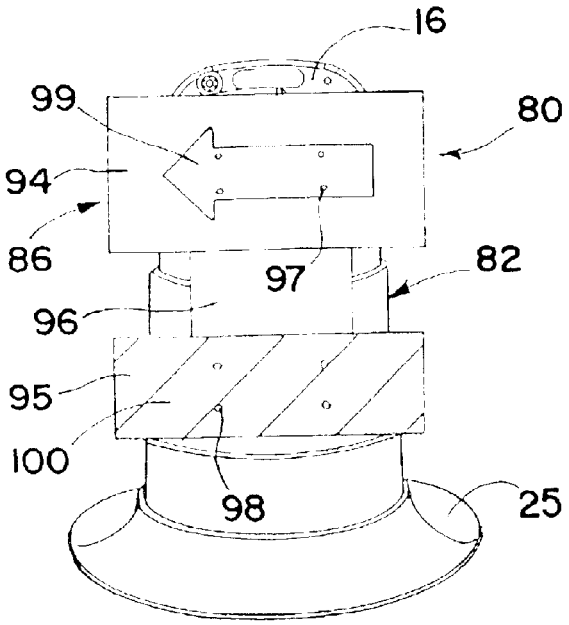
FIG. 10 is a schematic front elevation view of a portable sign assembly attached to a traffic channelizer device of the present invention to form a traffic barricade.
Figure 11:
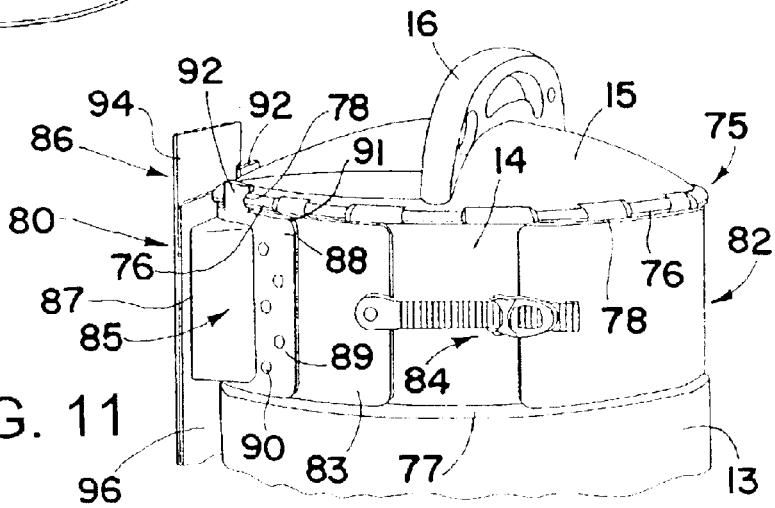
FIG. 11 is an enlarged fragmentary side elevation view of the upper portion of the portable sign assembly and traffic channelizer drum of FIG. 10.
Figure 12:
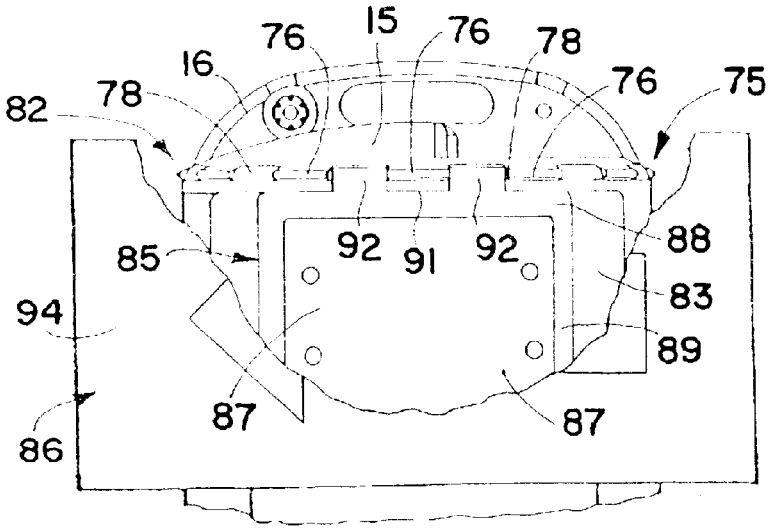
FIG. 12 is an enlarged fragmentary front elevation view of the portable sign assembly and traffic channelizer drum of FIG. 10 with portions of the sign assembly broken away to show how the sign assembly is prevented from rotating relative to the drum.

Another benefit in providing an intermittent stacking rim 75 on the top of any suitable traffic channelizer drum is that the rim tabs 76 may be used to prevent relative rotation of a portable sign assembly 80 when mounted on the top tier 14 of such a drum 82 as schematically shown in FIGS. 10-12 to provide a directional barricade for redirecting traffic and the like. Portable sign assembly 80 may be removably attachable to drum 82 as by means of a flexible band 83 having opposite ends connectable together by a suitable locking mechanism 84 (see FIG. 11) that may be adjustable to lengthen or shorten the spacing between the ends of the band to allow the band to fit different diameter drums. Mounted on the outer surface of band 83 is a sign support 85 used to attach a panel assembly 86 to the band. Sign support 85 may be molded out of a suitable plastic such as high density polyethylene, and may have a substantially planar front face 87 to facilitate attachment of the panel assembly 86 to the sign support and a curved rear face 88 radiused to substantially match the radius of curvature of the top tier 14 of the drum to which the portable sign assembly is adapted to be attached.

The ends 89 of the sign support 85 may protrude outwardly beyond opposite ends of the planar front face 87 to provide mounting surfaces for attaching the sign support to the band 83 using suitable fasteners 90 such as rivets extending through the mounting surfaces and band.

Extending upwardly from the upper edge 91 of the curved rear face 88 of the sign support 85 are two or more laterally spaced tabs 92 that are sized to fit between the intermittent stacking rim tabs 76 to prevent the portable sign assembly from rotating relative to the drum. Also, the upper edge 91 of the curved rear face 88 of the sign support fits underneath the intermittent stacking rim tabs 76 to prevent the portable sign assembly from inadvertently sliding up off the top of the drum. The transition shoulder 77 between the top tier 14 and next tier 13 of the stepped outer surface of the drum 82 prevents the portable sign assembly from inadvertently sliding down on the drum.

Portable sign assembly 80 may comprise one or more sign panels depending on the type of traffic barrier desired. For example, panel assembly 86 may only have one sign panel 94 (for providing a Type I barricade). In that event, the sign panel 94 may be attached directly to the sign support 85 by suitable fasteners such as nuts and bolts, screws or rivets extending through both parts. Alternatively, panel assembly 86 may include two or more sign panels 94 and 95 (for providing a Type II barricade). In that event, a drop panel 96 having a greater vertical height than the sign support 85 may be attached to the front face of the sign support to provide a larger attachment surface for attaching two or more sign panels 94 and 95 thereto. One of the sign panels 94 may be attached to the sign support 85 by one set of fasteners 97 extending through the sign panel and drop panel as well as the planar front face of the sign support, whereas the other sign panel 95 may be attached to the drop panel 96 by another set of fasteners 98 extending through the other sign panel and drop panel in vertical spaced relation below the one sign panel and sign support as schematically shown in FIG. 10. Such sign panels may have conventional markings on their respective front faces for carrying directional information. For example, one sign panel 94 may have reflective sheeting in the shape of an arrow 99 and the other sign panel 95 may have reflecting sheeting in the shape of stripes 100 or the like.

Although the invention has been shown and described with respect to certain embodiments, it is obvious that equivalent alterations and modifications will occur to others skilled in the art upon the reading and understanding of the specification. In particular, with regard to the various functions performed by the above described components, the term (including any reference to a "means") used to describe such components are intended to correspond, unless otherwise indicated, to any component which performs the specified function of the described component (e.g., that is functionally equivalent), even though not structurally equivalent to the disclosed component which performs the functions in the herein exemplary embodiments of the invention. In addition, while a particular feature of the invention may have been disclosed with respect to only one embodiment, such feature may be combined with one or more other features of other embodiments as may be desired or advantageous for any given or particular application.

What is claimed is:

1. A traffic channelizer device comprising a deformable hollow plastic drum having a side wall and an open bottom, a base having an upper portion adapted to be received within the open bottom, and a plurality of circumferentially spaced locking fingers extending radially inwardly from the side wall adjacent a bottom edge of the drum adapted to be received in a radially outwardly facing annular groove in the upper portion of the base for releasably retaining the upper portion of the base within the open bottom, the drum being deformable upon impact by a vehicle to cause the drum to flex sufficiently to become dislodged from the base leaving the base behind, the locking fingers being generally triangular shaped and having radially inwardly sloping sides and a rounded inner tip.

2. The device of claim 1 wherein the locking fingers have a substantially flat radial top surface that is adapted to engage a substantially flat radial upper surface of the annular groove in the upper portion of the base for retaining the upper portion of the base within the open bottom of the drum.

3. The device of claim 2 wherein the locking fingers have a tapered bottom surface and the upper portion of the base has a tapered upper edge that is engageable with the tapered bottom surface of the locking fingers during insertion of the upper portion of the base into the open bottom of the drum to facilitate flexing of the drum to allow the locking fingers to move past the tapered upper edge and into engagement with the annular groove.

4. The device of claim 1 wherein the locking fingers are double walled for increased strength and rigidity.

5. The device of claim 1 wherein the open bottom of the drum has an irregular shape, and the upper portion of the base has a corresponding irregular shape for maintaining a desired orientation of the drum relative to the base when the upper portion of the base is inserted into the open bottom.

6. The device of claim 5 wherein the base has a lower portion that extends radially outwardly beyond the upper portion of the base to provide a flat surface for supporting the drum off the ground.

7. The device of claim 6 wherein the base has a ribbed bottom for improved stability.

8. The device of claim 7 wherein a plurality of ribs on the bottom of the base extend in the same direction to form channels beneath the base allowing water to flow under the base.

9. The device of claim 1 wherein the side wall of the drum has a radially outwardly and axially downwardly tapering skirt portion adjacent the open bottom for resisting pull out of the drum from a ballasting collar adapted to be inserted over the drum, the drum being deformable upon impact by a vehicle to cause the drum to collapse sufficiently to permit the skirt portion to pass through the ballasting collar to dislodge the drum from the ballasting collar leaving the ballasting collar behind.

10. The device of claim 9 comprising a plurality of circumferentially spaced stiffening ribs integral with the skirt portion, the locking fingers being located adjacent a bottom edge of the drum intermediate the stiffening ribs.

11. The device of claim 10 wherein the skirt portion has at least one flat side with outwardly protruding corners adjacent the bottom edge of the drum to resist rolling of the drum when tipped on its side.

12. A traffic channelizer device comprising a deformable hollow plastic drum having a side wall and an open bottom, a base having an upper portion adapted to be received within the open bottom, and a plurality of circumferentially spaced locking fingers extending radially inwardly from the side wall adjacent a bottom edge of the drum adapted to be received in a radially outwardly facing annular groove in the upper portion of the base for releasably retaining the upper portion of the base within the open bottom, the drum being deformable upon impact by a vehicle to cause the drum to flex sufficiently to become dislodged from the base leaving the base behind, the locking fingers having a substantially flat radial top surface that is adapted to engage a substantially flat radial upper surface of the annular groove in the upper portion of the base for retaining the upper portion of the base within the open bottom of the drum and an angled bottom surface that is adapted to press against a lower surface of the annular groove in the upper portion of the base to eliminate chatter between the drum and base.

13. A traffic channelizer device comprising a deformable hollow plastic drum having a side wall and an open bottom, a base having an upper portion adapted to be received within the open bottom, and a plurality of circumferentially spaced locking fingers extending radially inwardly from the side wall adjacent a bottom edge of the drum adapted to be received in a radially outwardly facing annular groove in the upper portion of the base for releasably retaining the upper portion of the base within the open bottom, the drum being deformable upon impact by a vehicle to cause the drum to flex sufficiently to become dislodged from the base leaving the base behind, the side wall of the drum having a radially outwardly and axially downwardly tapering skirt portion adjacent the open bottom for resisting pull out of the drum from a ballasting collar adapted to be inserted over the drum, the drum being deformable upon impact by a vehicle to cause the drum to collapse sufficiently to permit the skirt portion to pass through the ballasting collar to dislodge the drum from the ballasting collar leaving the ballasting collar behind, and a plurality of circumferentially spaced stiffening ribs integral with the skirt portion, the locking fingers being located adjacent a bottom edge of the drum intermediate the stiffening ribs, the skirt portion having at least one flat side with outwardly protruding corners adjacent the bottom edge of the drum to resist rolling of the drum when tipped on its side, the bottom edge of the drum having a curved portion opposite the flat side, and the stiffening ribs progressively increasing in size and radial extent of protrusion from the approximate midpoint of the curved portion to the protruding corners.

14. A traffic channelizer device comprising a deformable hollow plastic drum having a side wall and an open bottom, a base having an upper portion adapted to be received within the open bottom, and a plurality of circumferentially spaced locking fingers extending radially inwardly from the side wall adjacent a bottom edge of the drum adapted to be received in a radially outwardly facing annular groove in the upper portion of the base for releasably retaining the upper portion of the base within the open bottom, the drum being deformable upon impact by a vehicle to cause the drum to flex sufficiently to become dislodged from the base leaving the base behind, the side wall of the drum having a radially outwardly and axially downwardly tapering skirt portion adjacent the open bottom for resisting pull out of the drum from a ballasting collar adapted to be inserted over the drum, the drum being deformable upon impact by a vehicle to cause the drum to collapse sufficiently to permit the skirt portion to pass through the ballasting collar to dislodge the drum from the ballasting collar leaving the ballasting collar behind, and a radially outwardly protruding mounting surface on the exterior of the drum adjacent the drum bottom for supporting a friction pad that is adapted to be contacted by the inner diameter of the ballasting collar placed over the drum to prevent rotation of the drum relative to the ballasting collar.

15. The device of claim 14 wherein the friction pad is round and is contacted by the inner diameter of the ballasting collar at two points adjacent opposite sides of the friction pad.

16. The device of claim 14 wherein the mounting surface and the friction pad mounted thereon extend radially outwardly and axially downwardly to facilitate clearing of the inner diameter of the ballasting collar with the top of the friction pad when placed over the drum.

17. The device of claim 14 wherein the mounting surface is sufficiently flexible to permit use of friction pads of slightly different thicknesses and still provide the necessary contact between the inner diameter of the ballasting collar and the friction pad to prevent relative rotation between the ballasting collar and drum.

18. The device of claim 14 wherein the mounting surface is concave across its width to cause the friction pad to dish out to ensure that the inner diameter of the ballasting collar contacts the friction pad at two points adjacent opposite sides of the friction pad.

19. A traffic channelizer device comprising a deformable hollow plastic drum having a side wall and an open bottom, a base having an upper portion adapted to be received within the open bottom, and a plurality of circumferentially spaced locking fingers extending radially inwardly from the side wall adjacent a bottom edge of the drum adapted to be received in a radially outwardly facing annular groove in the upper portion of the base for releasably retaining the upper portion of the base within the open bottom, the drum being deformable upon impact by a vehicle to cause the drum to flex sufficiently to become dislodged from the base leaving the base behind, the side wall of the drum having a radially outwardly and axially downwardly tapering skirt portion adjacent the open bottom for resisting pull out of the drum from a ballasting collar adapted to be inserted over the drum, the drum being deformable upon impact by a vehicle to cause the drum to collapse sufficiently to permit the skirt portion to pass through the ballasting collar to dislodge the drum from the ballasting collar leaving the ballasting collar behind, and a plurality of circumferentially spaced stiffening ribs integral with the skirt portion, the skirt portion having at least one flat side with outwardly protruding corners adjacent the bottom edge of the drum to resist rolling of the drum when tipped on its side, the bottom edge of the drum having a curved portion opposite the flat side, and the stiffening ribs progressively increasing in size and radial extent of protrusion from the approximate midpoint of the curved portion to the protruding corners.

20. A traffic channelizer device comprising a deformable hollow plastic drum having a side wall and an open bottom, a base having an upper portion adapted to be received within the open bottom, and a plurality of circumferentially spaced locking fingers extending radially inwardly from the side wall adjacent a bottom edge of the drum adapted to be received in a radially outwardly facing annular groove in the upper portion of the base for releasably retaining the upper portion of the base within the open bottom, the drum being deformable upon impact by a vehicle to cause the drum to flex sufficiently to become dislodged from the base leaving the base behind, the locking fingers having a substantially flat radial top surface that is adapted to engage a substantially flat radial upper surface of the annular groove in the upper portion of the base for retaining the upper portion of the base within the open bottom of the drum and a flat downwardly and outwardly tapered bottom surface, and the upper portion of the base having a flat downwardly and outwardly tapered upper edge that is engageable with the flat downwardly and outwardly tapered bottom surface of the locking fingers during insertion of the upper portion of the base into the open bottom of the drum to facilitate flexing of the drum to allow the locking fingers to move past the tapered upper edge of the base and into engagement with the annular groove.

21. A traffic channelizer device comprising a deformable hollow plastic drum having a side wall and an open bottom, a base having an upper portion adapted to be received within the open bottom, and a plurality of circumferentially spaced locking fingers extending radially inwardly from the side wall adjacent a bottom edge of the drum adapted to be received in a radially outwardly facing annular groove in the upper portion of the base for releasably retaining the upper portion of the base within the open bottom, the drum being deformable upon impact by a vehicle to cause the drum to flex sufficiently to become dislodged from the base leaving the base behind, the side wall of the drum having a radially outwardly and axially downwardly tapering skirt portion adjacent the open bottom for resisting pull out of the drum from a ballasting collar adapted to be inserted over the drum, the drum being deformable upon impact by a vehicle to cause the drum to collapse sufficiently to permit the skirt portion to pass through the ballasting collar to dislodge the drum from the ballasting collar leaving the ballasting collar behind, and a plurality of circumferentially spaced stiffening ribs integral with the skirt portion, the locking fingers being located adjacent a bottom edge of the drum intermediate the stiffening ribs.

* * * * *